United States Patent [19]

Parisien

[11] 4,140,416

[45] Feb. 20, 1979

[54] FLOOR FLANGE

[76] Inventor: Rudolph E. Parisien, 891 Rainbow St., Ottawa, Ontario, Canada

[21] Appl. No.: 807,147

[22] Filed: Jun. 16, 1977

[30] Foreign Application Priority Data

Jun. 23, 1976 [CA] Canada ..... 255534

[51] Int. Cl.[2] ..... F16B 9/00

[52] U.S. Cl. ..... 403/199; 52/243; 52/296; 256/65

[58] Field of Search ..... 256/22, 24, 59, 65; 52/243, 296, 292, 272, 289; 403/199, 192, 187

[56] References Cited

U.S. PATENT DOCUMENTS

| | | | |
|---|---|---|---|
| 3,267,627 | 8/1966 | Hammitt | 403/192 X |
| 3,274,741 | 9/1966 | Neagle | 52/243 X |
| 3,304,683 | 2/1967 | Ferreira | 256/24 X |

FOREIGN PATENT DOCUMENTS

| | | | |
|---|---|---|---|
| 2331740 | 1/1975 | Fed. Rep. of Germany | 403/192 |

*Primary Examiner*—Andrew V. Kundrat
*Attorney, Agent, or Firm*—A. W. Breiner

[57] ABSTRACT

The floor flange is primarily for anchoring lower end of channel type fence posts to a floor or the like and consists essentially of two spaced apart rectangular boxes joined by a common bottom wall which is adapted to the secured to the floor by lag screws or the like. Each box has a pair of parallel upright sidewalls, a top wall and a back wall joined thereto and to the bottom wall. The remaining side of the box is open to provide access to the interior. Two adjacent side walls of the box are provided with aligned apertures to receive a bolt. The dimensions of at least one of the boxes is such that a lower end of a channel type post will be received thereon. In addition the bolt extending through the side wall will extend through a slot in the wall of the channel member and thus tightening of the bolt causes the sidewalls to be urged against the wall of the channel member so as to secure it to the floor flange.

1 Claim, 4 Drawing Figures

FLOOR FLANGE

This invention relates to floor flanges and more particularly to flanges for anchoring fence posts to a floor so as to support fencing material of a partition or fence such as the type required in the interior of a building for storage purposes.

The flange is intended for use with rectangular posts and particularly channel type posts. Known floor flanges have not been particularly suitable for anchoring posts which are unsupported at their upper ends. Furthermore known flanges were not designed particularly for use with channel type posts the side edges of which are bent inwardly to define a pair of J-shaped portions defining a slot therebetween.

Accordingly it is an object of this invention to provide a floor flange which is more capable of withstanding the lateral forces which might be applied to the posts of partitions or fences.

A further object of this invention is the provision of a floor flange particularly suitable for use in anchoring channel type posts having side walls bent inwardly to define a slot therebetween.

A still further object is the provision of a floor flange which will support the bottom rail of a partition or fence.

Accordingly, the present invention provides a floor flange for use with a channel type post. The flange comprising a pair of spaced apart substantially rectangular boxes joined by a common bottom wall which is adapted to be secured to a floor, two adjacent side walls of the two boxes are substantially parallel and spaced apart and have aligned apertures to receive a bolt. One side of each said box being open to permit access to the interior of each said box, the dimensions of a first one of said boxes being such that an end of said post is adapted to be slid onto said first box with said bolt extending through a slot in said post whereby tightening said bolt causes said post to be held in place.

In the accompanying drawings which illustrate emodiments of the invention,

Figure 1:
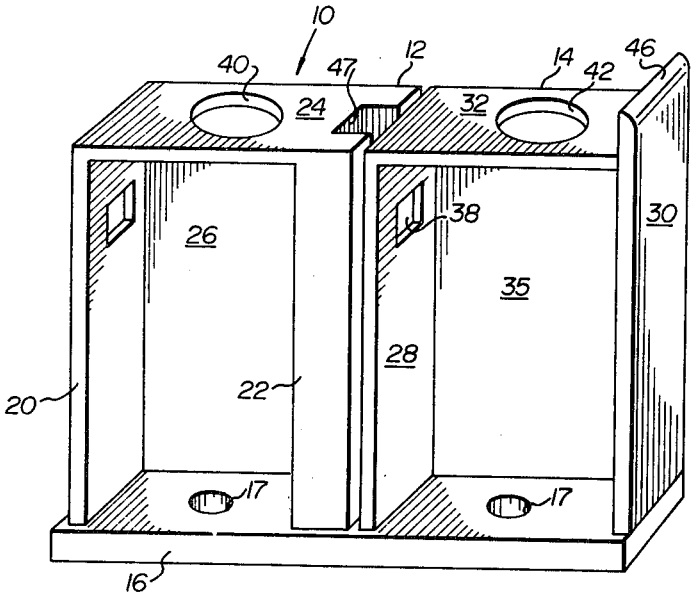
FIG. 1 is a perspective view of the floor flange.

Referring now in detail to the drawings, a floor flange shown generally at 10 in FIG. 1 is preferably moulded and includes two spaced apart substantially rectangular boxes 12 and 14 joined by a common wall 16 which forms the base of the floor flange. The base 16 is provided with apertures 17 through which fastening means such as lag screws extend to anchor the flange 10 to the floor as shown in FIG. 4.

The first box 12 has a pair of parallel upright side walls 20 and 22, a top wall 24 and a back wall 26 joined thereto and to the bottom wall 16. Similarly, the second box 14 has a pair of upright side walls 28 and 30, a top wall 32 and a back wall 35 joined thereto and to the common bottom wall 16. The adjacent side walls 22 and 28 of the boxes are provided with aligned apertures 36 and 38 (see also FIGS. 3 & 4) through which a carriage bolt 39 extends so as to be provided with a nut 40 bearing against the inner face of the side wall 28.

Figure 4:
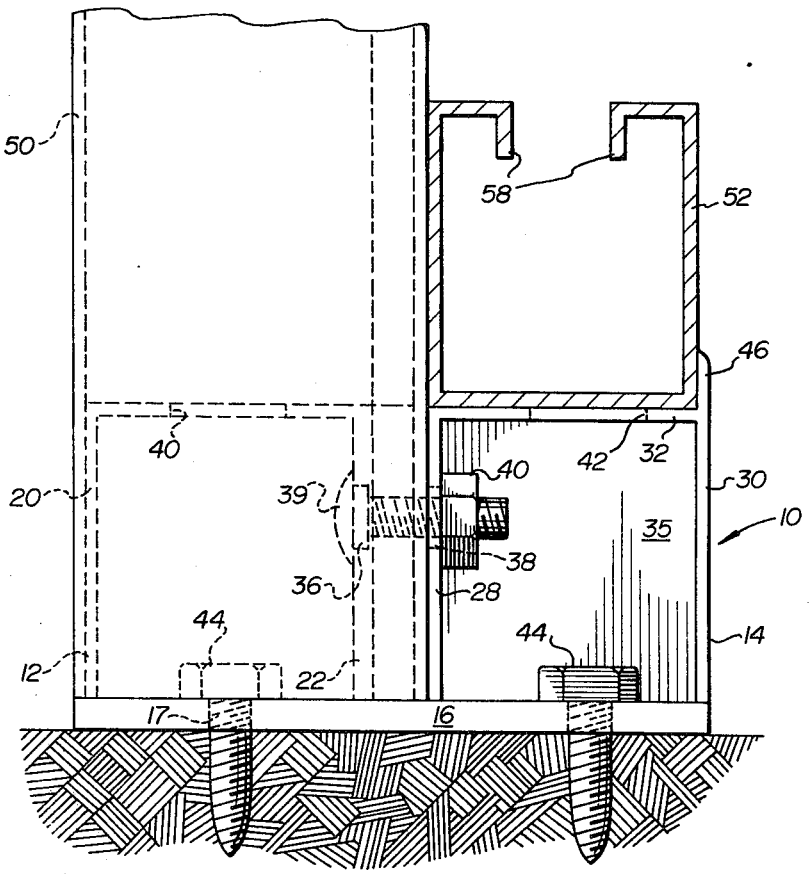

The top walls 12 and 14 also have apertures 40 and 42 respectively of sufficient size to allow a socket wrench to be inserted thereby facilitating the turning of lag screws 44 or the like shown in FIG. 4.

It should also be noted that the side wall 30 of the second box 14 extends above the top wall 32 (for purposes to be described below) thus forming a projection 46.

Figure 3:
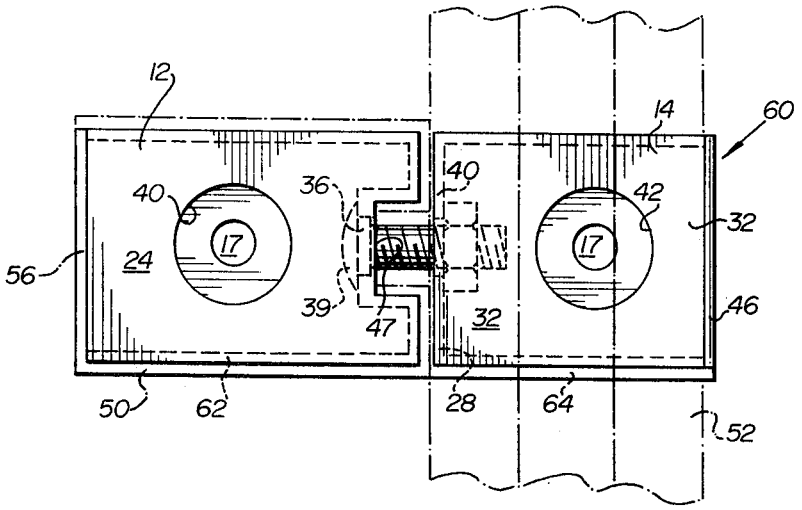
FIG. 3 is a top plan view of an alternative floor flange showing a post and a rail in position thereon in broken lines and FIG. 4 is a side elevational view of the floor flange, post and rail of FIG. 2.

The side wall 22 of the first box 12 is provided with a longitudinally extending indentation 47 to receive inturned portions of side walls of a channel type post 50 shown in broken lines in FIGS. 3 and 4. Since the post 50 and the rail 52 are preferrably identical in shape it appears necessary to describe only the post 50. Accordingly, the post 50 comprises a channel member having a pair of side walls and an interconnecting wall 56. The edges of the side walls 53 and 54 are bent inwardly and toward the interconnecting wall to provide ribs 58 defining a slot therebetween. These ribs 58 are received in the indentation 47 in the box 12.

Figure 2:
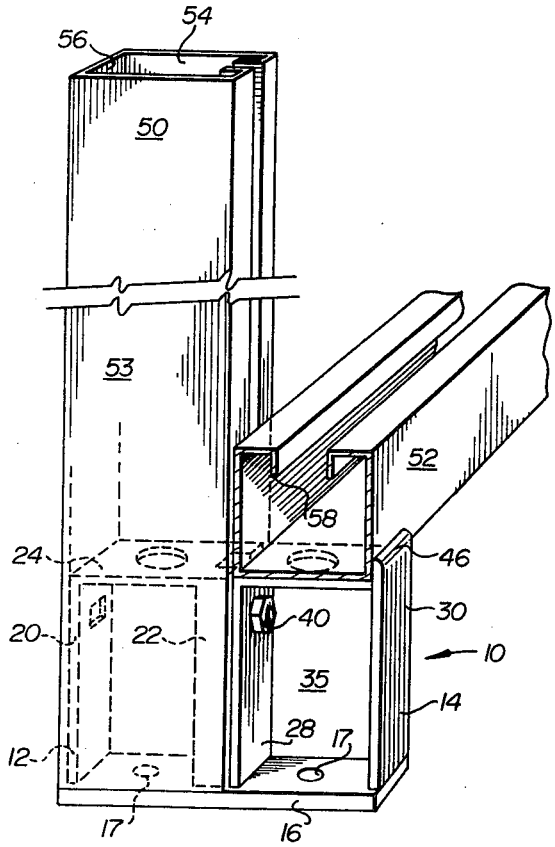
FIG. 2 is a perspective view of the floor flange with a post and rail in position thereon.

With reference to FIG. 3 an alternative embodiment of the flange of FIGS. 1, 2 and 4 is shown generally at 60. The floor flange 60 is substantially the same as the floor flange 10 with the exception that access to the enterior of the boxes 12 and 14 is provided through the elimination of the walls 20 and 30 thereby making it possible to provide front walls 62 and 64 in their place to support the top walls 24 and 32 thus providing the necessary rigidity. The top walls 24 and 32, side walls 22 and 28, back walls 26 and 35 and the bottom wall 16 of flange 60 are essentially the same as that of the flange 10. One advantage of this construction is that it is possible to turn the nut 40 with a socket wrench. However, it would also be possible to turn the nut 40 in the flange 10 if a suitable aperture were provided in the wall 30 of the flange 10.

In use the floor flange 10 is positioned so that lag screws 44 for example can be inserted through the apertures 17 in the base 16 into lead sleeves previously provided in bore holes in the concrete floor. The lag screws 44 are conveniently tightened by inserting a socket wrench through the apertures 40 and 42 in the top walls 24 and 32 of the flange 10. It is also possible to use an ordinary box end or open end wrench to tighten the lag bolts 44 as access may be gained through the open side walls of the boxes 12 and 14.

Presuming the carriage bolt 39 has previously been loosely assembled on the flange 10 so that its square portion engages in the square aperture 36 in the side wall 22 (as shown in FIG. 4) a desired length of post is slid onto the box 12 so that the ribs 58 will be received in the indentation 47. The nut 40 is then tightened so that the post is wedged between side walls 22 and 28 of the flange 10 thus holding the post 50 against upward movement and at the same time fastening the upper ends of the boxes together to provide a flange of increased strength. The necessary posts 50 having been positioned on and secured to flanges 10, the horizontal bottom rail 52 is then positioned so as to rest on the top wall 32 of the box 14 and have its one side wall against the post 50 and its other side wall against the projection 46. Where it is necessary to restrain the bottom rail 52 against upward movement a hole is drilled therethrough in alignment with the aperture 42 in the top wall and a bolt and suitable washer are used in the apertures.

It should be pointed out that in the moulding of the flanges 10 and 60 it is necessary to provide a mould part which extends into the space between the walls 22 and 28 so as to form the indentation 47. This mould part must have sufficient draft to allow it to be withdrawn and thus walls 22 and 28 will not be parallel in that they will be spaced apart more at the top than the bottom. To compensate for this the base 16 is formed with a slight arch so that when the nut on the carriage bolt 39 is tightened the walls 22 and 28 are drawn together so as to be parallel and the base 16 is straightened so as to become flat thus removing the arch formed in the casting.

Furthermore it is also possible to provide access to the lag bolt 44 and the carriage bolt 39 by removing the top walls 24 and 32 rather than the side walls 20 and 30 while providing front walls 62 and 64 as shown in FIG. 3.

The embodiment of the invention in which an exclusive property or privilege is claimed are defined as follows:

1. A floor flange for use with a channel type post, said flange comprising a pair of spaced apart substantially rectangular boxes joined by a common bottom wall which is adapted to be secured to a floor, each of said boxes having a pair of parallel upright side walls, a top wall, and a back wall joined thereto and to said bottom wall, two adjacent walls of said boxes being substantially parallel and spaced apart and having aligned apertures to receive a bolt, one wall of each said box being open to permit access to the interior of each said box, the dimensions of a first one of said boxes being such that an end of said post is adapted to be slid onto said first box with said bolt extending through a slot in said post whereby tightening of said bolt causes said post to be held in place.

* * * * *